United States Patent [19]

Felder

[11] 4,107,936

[45] Aug. 22, 1978

[54] CENTRIFUGAL AIR CONDITIONER

[76] Inventor: Donald Wayne Felder, 837 Hillside Dr., Sherman, Tex. 75090

[21] Appl. No.: 757,458

[22] Filed: Jan. 6, 1977

[51] Int. Cl.[2] ..... F25B 9/02

[52] U.S. Cl. ..... 62/5

[58] Field of Search ..... 62/5

[56] References Cited

U.S. PATENT DOCUMENTS

| | | | |
|---|---|---|---|
| 3,197,969 | 8/1965 | Over | 62/5 |
| 3,922,871 | 12/1975 | Bolesta | 62/5 |

*Primary Examiner*—Lloyd L. King

*Attorney, Agent, or Firm*—Harrington A. Lackey

[57] ABSTRACT

A centrifugal air conditioner for both heating and cooling comprising a housing enclosed cylinder to be rotated during operation by conventional means so that air is caused to enter one end of the cylinder and accelerated in a circular path causing a vortex effect to centrifugally separate the hot air from the cold air. The cylinder having air outlets to release the hot air and the cold air separately. The housing having means for collecting and exiting the hot and cold air separately.

6 Claims, 6 Drawing Figures

5
4
3
2
1
20
2
13
7
8
10
5
18
19
4
9
12
M
6
3
13
14
15
16
11
17
6
2
3
5
4

20
7
2
1
13

CENTRIFUGAL AIR CONDITIONER

SUMMARY

The present invention pertains generally to air conditioner assemblies and more particularly to air conditioners for heating and cooling living and working space.

It has long been the objective of the air conditioner industry to develop simpler, more efficient and more durable air conditioner systems for both heating and cooling.

It is therefore a primary object of the present invention to provide a centrifugal air conditioner which is simple and durable in construction and which can be manufactured and maintained at a reasonable cost.

Having in mind the above and other objects that will be evident from an understanding of this disclosure, the present invention comprises the combinations and arrangements of parts illustrated in the presently preferred embodiment of the invention which are hereinafter set forth in sufficient detail to enable those persons skilled in the art to clearly understand the function, operation, construction and advantages of it when read in conjunction with the accompanying drawings.

DETAILED DESCRIPTION

Figure 1:
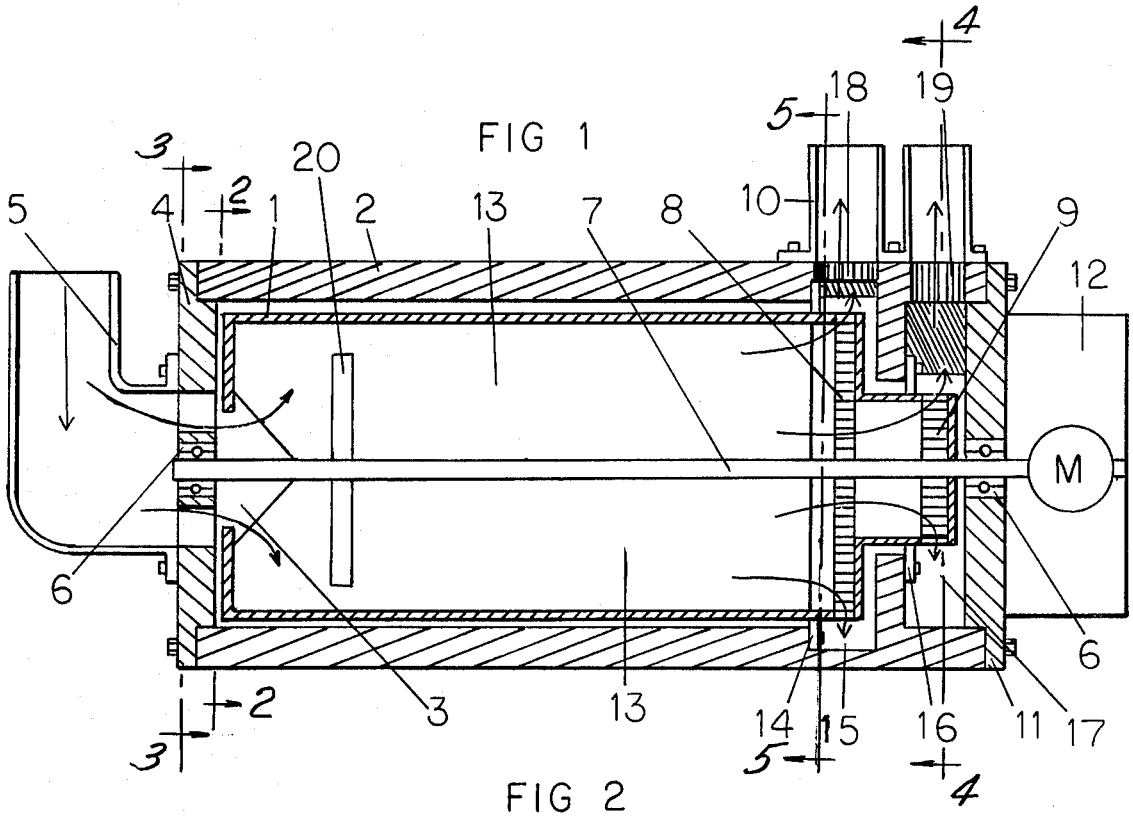
FIG. 1 is a cross sectional side view of the air conditioner assembly according to the present invention.
Figure 2:
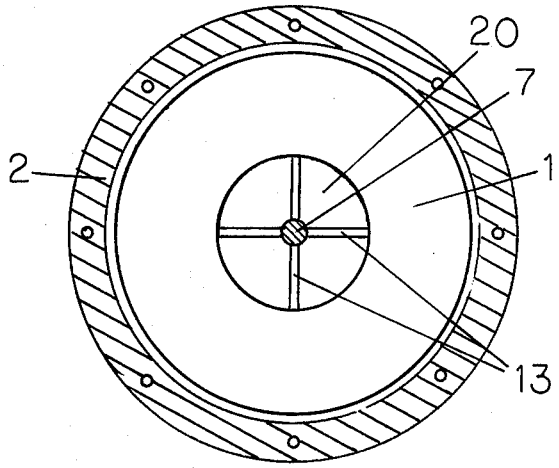
FIG. 2 is a slightly enlarged section taken along the line 2—2 of FIG. 1.
Figure 3:
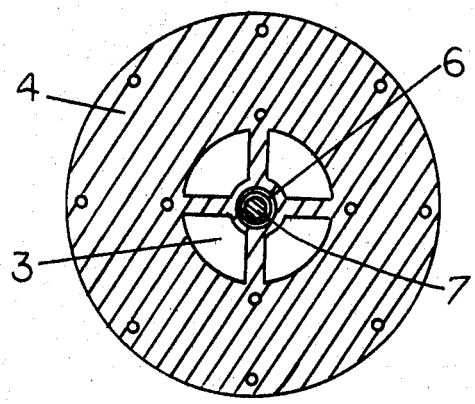
FIG. 3 is a section taken along the line 3—3 of of FIG. 1.
Figure 4:
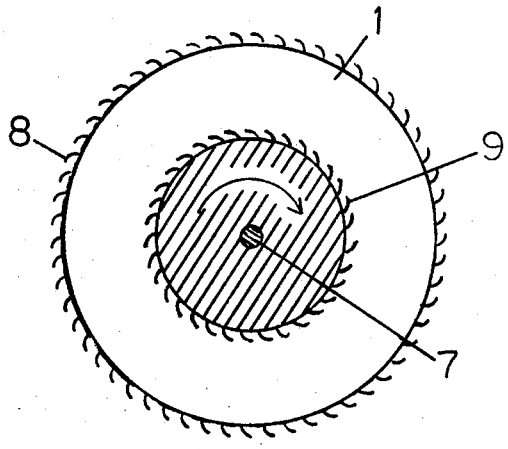
FIG. 4 is a section taken along the line 4—4 of FIG. 1, disclosing the cylinder 1 with the housing 2, removed.
Figure 5:
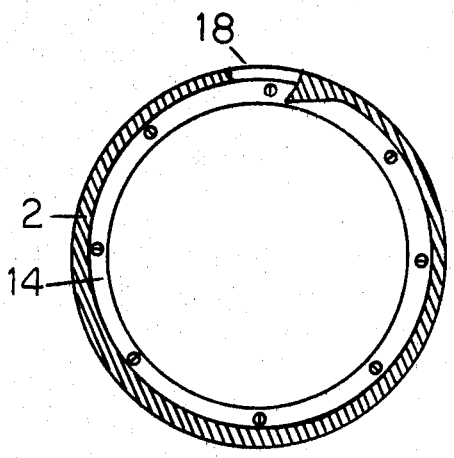
FIG. 5 is a section taken along the line 5—5 of FIG. 1, disclosing the housing 2, with the cylinder 1 removed.
Figure 6:
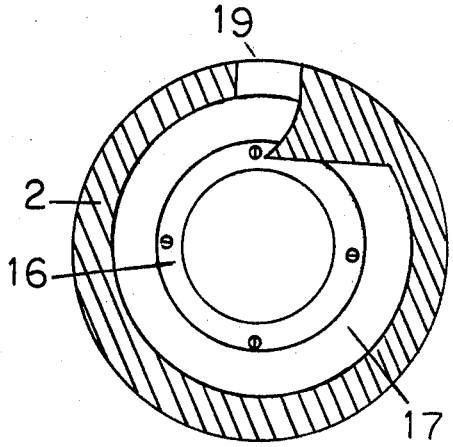
FIG. 6 is a section taken along the line 4—4 of FIG. 1, disclosing the housing 2, with the cylinder 1 removed.

As seen in FIGS. 1 and 2, the centrifugal air conditioner assembly comprises a housing 2 having a generally circular shaped cross section with outlet end plate 11 and inlet end plate 4 to which inlet manifold 5 is attached. End plates 4 and 11 have bearings 6 mounted in their centers to accommodate shaft 7 for mounting cylinder 1 in the housing 2. End plate 4 has cut-out areas, as seen in FIG. 3, to allow inlet air to enter the housing 2. The housing 2 has at the opposite end from the air inlet 3 on the top, as seen in FIG. 1, hot air outlet port 18 and cold air outlet port 19 with outlet manifold 10 attached. The hot air collection chamber 15, as seen in FIG. 1 and 5, is generally circular in shape with a protrusion into the chamber to assist in diverting the hot air from the chamber 15 into the hot air outlet port 18. An air seal 14, as seen in FIGS. 1 and 5, is installed in chamber 15 to prevent hot air from going around the cylinder 1, back to the intake 3. The cold air collection chamber 17, as in FIGS. 1 and 6, is generally circular in shape with a protrusion into the chamber 17 to assist in diverting cold air to the cold air port 19. An air seal 16, as in FIGS. 1 and 6, is installed in chamber 17 to prevent cold air and hot air re-mixing inside the housing 2. A rotatable cylinder 1, mounted in housing 2, has an open inlet end 3, and at its opposite end a hot air outlet 8 around the outer circumference of the cylinder 1 and a cold air outlet 9 around the outer circumference of a smaller circular protrusion. Baffles 13 run the major portion of the length of the cylinder 1 and are evenly spaced and radially disposed from the center shaft 7 to the inner wall of cylinder 1. Baffle 20 is disc-shaped and mounted concentric to shaft 7 approximately one sixth the length of the cylinder 1 from the inlet 3 end and is of a diameter approximately three fourths of the diameter of the cylinder 1. The portion of cylinder 1 between the inlet 3 and baffle 20 acts as a centrifugal air pump to pull air in the inlet 3 and push it toward the inner wall of cylinder 1 where it is forced around the outer circumference of baffle 20 into the remaining portion of the cylinder 1, as it rotates. The baffles 13 in the remaining portion of the cylinder 1 continue to spin the air, forming a vortex effect, causing the air to stratify with the hotter molecules having the highest molecular velocity being forced outward against the walls of the cylinder 1. The hot air outlet 8, as seen in FIGS. 1 and 4, is a squirrel-cage type fan of a size to sufficiently restrict the flow of air, that a back pressure is built up to force the cold air through the cold air outlet 9 which is also a squirrel-cage type fan. Due to the pressure inside the cylinder 1 and the spinning of the air, air passing out through outlets 8 and 9 of the squirrel-cage fans has a turbine effect, to give a power return to the cylinder 1. Inlet manifold 5, as seen in FIG. 1, provides an attachment point for ducting for inlet air. Air outlet manifold 10, as seen in FIG. 1 provides an attachment point for hot and cold air ducting. Shaft 7, as seen in FIG. 1, runs the length of the housing 2 and extends out the outlet end plate 11, to allow attachment of conventional motor 12 for rotating the cylinder 1.

During operation, the cylinder 1 is caused to rotate, drawing air into the cylinder 1 through inlet 3 centrifugally forcing the air toward the inner wall of cylinder 1, around baffle 20, which causes all intake air to pass toward the outer circumference to the cylinder 1, to give a more uniform velocity to the air and allow a lower operating RPM. As the air travels along the cylinder 1, the baffles 13 cause the air to continue to spin, forming a vortex effect, causing the air to stratify with the hotter molecules having the highest molecular velocity being forced outward toward the wall of the cylinder 1, with the cooler molecules having a slower molecular velocity being forced by back pressure toward the center of the cylinder 1. The hot air passes from the cylinder 1 through hot air outlet 8 into the hot air collection chamber 15, from which it passes through hot air port 18 into the air outlet manifold 10, from which it is ducted to a conventional valve system (not shown) to be used for heating purposes when required, and ducted to the atmosphere when the assembly is used for cooling. The cooler air from cylinder 1 passes through the cold air outlet 9, into the cold air collection chamber 17, from which it passes through cold air port 19 into the outlet air manifold 10, from which it is ducted to a conventional valve system (not shown) to be used for cooling purposes when required, and ducted to the atmosphere when the assembly is used for heating.

Various modifications of the centrifugal air conditioner assembly will become apparent to those persons ordinarily skilled in the art and the present invention is intended to cover all such obvious modifications falling within the spirit and scope of the invention defined in the appended claims.

I claim:

1. A centrifugal air conditioner comprising:

(a) an elongated, hollow cylinder including a cylindrical air chamber having at one end an air inlet port, and having an opposite outlet end portion, (b) a shaft fixed to and extending coaxially through said cylinder, (c) journal means mounting said shaft for rotary movement, (d) a plurality of vanes fixed to, and circumferentially spaced about, said shaft, said vanes extending substantially the length of said cylindrical chamber and projecting radially from said shaft to the cylindrical wall of said chamber, (e) a disc-shaped baffle fixed to said shaft closer to said inlet port than said outlet end portion, said baffle intersecting said vanes and having a radius less than the radius of said cylindrical chamber to separate said air chamber into a pumping chamber adjacent said inlet port and a vortex chamber adjacent said outlet end portion, (f) discharge means at the outlet end portion of said cylinder for separately discharging air of different temperatures from said air chamber, and (g) means for rotatably driving said shaft.

2. The invention according to claim 1 further comprising an elongated housing having an inlet end portion and an opposite outer end portion, said journal means mounting said shaft in said housing for rotatably supporting said cylinder coaxially within said housing, said inlet port registering with the inlet end portion of said housing, and the outlet end portion of said cylinder being in registry with the outlet end portion of said housing.

3. The invention according to claim 2 in which the outlet end portion of said housing comprises a hot air outlet chamber and a cool air outlet chamber, said outlet chambers being longitudinally spaced and hermetically separated, the outlet end portion of said cylinder comprising a peripheral hot air outlet formed in the wall of said cylinder communicating with said hot air outlet chamber, said cylinder having a reduced end portion extending into said cool air outlet chamber and a cool air outlet in said reduced end portion communicating with said cool air outlet chamber.

4. The invention according to claim 2 in which said hot air outlet is sufficiently restricted to produce backpressure in said cylinder to force cooler air out through said cool air outlet.

5. The invention according to claim 3 in which said hot air outlet is at a radial distance from said shaft substantially greater than the radial distance of said cool air outlet from said shaft, said radial distance of said cool air outlet being greater than the radius of said air inlet port.

6. The invention according to claim 5 in which said hot air outlet is circumferentially coextensive with the wall of said cylinder and includes a first squirrel-cage type fan, and said cool air outlet is circumferentially coextensive with the wall of said reduced end portion and includes a second squirrel-cage type fan.

* * * * *